US008877007B2

(12) United States Patent
Ni et al.

(10) Patent No.: US 8,877,007 B2
(45) Date of Patent: Nov. 4, 2014

(54) SYSTEM AND METHOD FOR RECLAIMING REJECTS IN SULFITE PULPING

(71) Applicant: University of New Brunswick, Fredericton (CA)

(72) Inventors: Yonghao Ni, Fredericton (CA); Guojun Kang, Fredericton (CA)

(73) Assignee: University of New Brunswick, Fredericton (CA)

( * ) Notice: Subject to any disclaimer, the term of this patent is extended or adjusted under 35 U.S.C. 154(b) by 0 days.

(21) Appl. No.: 13/972,561

(22) Filed: Aug. 21, 2013

(65) Prior Publication Data

US 2014/0053993 A1 Feb. 27, 2014

Related U.S. Application Data

(60) Provisional application No. 61/691,646, filed on Aug. 21, 2012.

(51) Int. Cl.
*D21C 3/06* (2006.01)
*D21C 3/26* (2006.01)

(52) U.S. Cl.
CPC ..... *D21C 3/266* (2013.01)
USPC ..... 162/83; 162/82

(58) Field of Classification Search
CPC ..... D21C 3/06; D21C 9/007; D21B 1/12
USPC ..... 162/24, 25, 82, 83, 84, 85
See application file for complete search history.

(56) References Cited

U.S. PATENT DOCUMENTS

| | | | | |
|---|---|---|---|---|
| 1,915,862 | A | | 6/1933 | Morden |
| 2,791,503 | A | | 5/1957 | Lyon et al. |
| 2,913,362 | A | | 11/1959 | Cusi |
| 3,073,737 | A | | 1/1963 | Crosby et al. |
| 3,393,121 | A | | 7/1968 | Lea et al. |
| 3,830,688 | A | * | 8/1974 | Mannbro ..... 162/29 |
| 4,220,498 | A | | 9/1980 | Prough |
| 4,502,918 | A | | 3/1985 | Mackie et al. |
| 4,895,619 | A | | 1/1990 | Ahs et al. |
| 5,145,010 | A | | 9/1992 | Danielsson et al. |
| 5,564,572 | A | | 10/1996 | Iwashige et al. |

(Continued)

FOREIGN PATENT DOCUMENTS

| | | |
|---|---|---|
| WO | 87/05954 | 10/1987 |
| WO | 02/090651 | 11/2002 |
| WO | 2004/003288 | 1/2004 |
| WO | 2011/102760 | 8/2011 |

OTHER PUBLICATIONS

Smook, Handbook for Pulp and Paper Technologists, 1992, Angus Wilde Publications, 2nd edition, chapters 3, 4, 8, and 13.*

(Continued)

*Primary Examiner* — Anthony Calandra
(74) *Attorney, Agent, or Firm* — Quarles & Brady, LLP

(57) ABSTRACT

Systems and methods are provided for refining and reclaiming rejects in a sulfite pulping process. Wood chips and sulfite cooking liquor are provided to a digester for delignification. The slurry obtained from the digester is screened to obtain a reject portion containing sulfite rejects. The sulfite rejects are disintegrated in a refiner, such that the rejects are refined to a freeness suitable for digestion in a subsequent re-cooking step. Refined rejects are then returned to the digester for re-cooking with wood chips.

13 Claims, 1 Drawing Sheet

(56) References Cited

U.S. PATENT DOCUMENTS

| | | | |
|---|---|---|---|
| 5,575,395 | A | 11/1996 | Alajaaski et al. |
| 5,672,245 | A | 9/1997 | Andtbacka et al. |
| 5,996,806 | A | 12/1999 | Vikio |
| 6,361,650 | B1 | 3/2002 | Danielsson et al. |
| 2004/0231811 | A1 | 11/2004 | Engstrand et al. |
| 2007/0023329 | A1 | 2/2007 | Sandberg et al. |
| 2008/0308239 | A1 | 12/2008 | Hart et al. |
| 2009/0032207 | A1 | 2/2009 | Laurila-Lumme et al. |
| 2011/0036523 | A1 | 2/2011 | Harkonen et al. |
| 2011/0232853 | A1 | 9/2011 | Yin |
| 2012/0097350 | A1 | 4/2012 | Heimburger et al. |

OTHER PUBLICATIONS

Smook, Handbook of Pulp and Paper Terminology, 1990, Angus Wilde Publications, 2nd edition, chapters 11-12.*

* cited by examiner

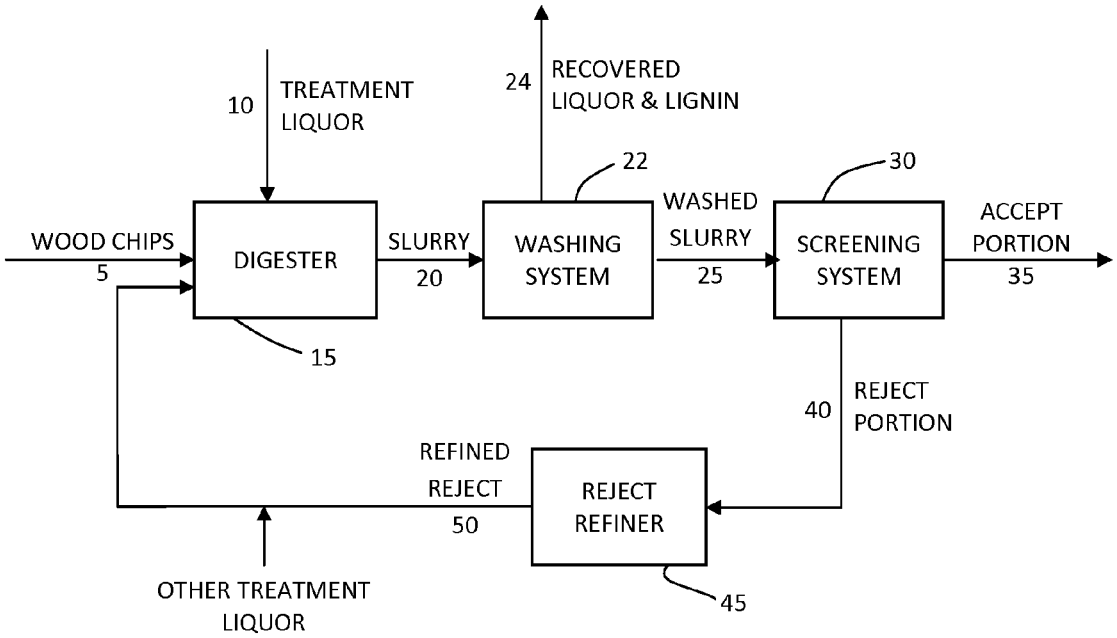
10
TREATMENT
LIQUOR
24
RECOVERED
LIQUOR & LIGNIN
22
30
WOOD CHIPS
5
DIGESTER
SLURRY
20
WASHING
SYSTEM
WASHED
SLURRY
25
SCREENING
SYSTEM
ACCEPT
PORTION
35
15
40
REJECT
PORTION
REFINED
REJECT
50
REJECT
REFINER
OTHER TREATMENT
LIQUOR
45

SYSTEM AND METHOD FOR RECLAIMING REJECTS IN SULFITE PULPING

CROSS-REFERENCE TO RELATED APPLICATION

This application claims priority to U.S. Provisional Application No. 61/691,646, entitled "SYSTEM AND METHOD FOR RECLAIMING REJECTS IN SULFITE PULPING" and filed on Aug. 21, 2012, the entire contents of which is incorporated herein by reference.

BACKGROUND

The present disclosure relates to systems and methods for processing screen rejects in sulfite pulping.

Chemical paper pulping is a process in which wood chips are initially chemically processed in a digester in order to reduce the lignin content, prior to bleaching. After the initial digestion step, undercooked wood chips are separated from the resulting pulp fibers using a screening system (e.g. also known as a knotter), which separates a reject portion from an accept portion. The reject portion typically includes residual wood chips that have not been sufficiently digested, such as knotted or oversized chips, which are commonly referred to as "screen rejects" or simply "rejects". While the accept portion is suitable for further processing to produce pulp/paper, the reject portion is removed, thus resulting in a loss of material and a reduction in yield. The screen rejects thus represent a material loss within the chemical pulping process and it is generally desirable to reprocess or reuse the screen rejects.

In the Kraft process, which is a sulfate chemical process, the Kraft screen rejects have a low lignin content and low level of lignin condensation, rendering Kraft screen rejects amenable to a wide range of reprocessing methods. For example, as taught in U.S. Pat. No. 5,672,245, Kraft screen rejects, having been separated from the accept portion, may be returned to the chip chute for further digestion in the digester along with fresh wood chips. Similarly, as taught in PCT Patent Application No. PCT/SE2010/050181, Kraft screen rejects may be recirculated to the digester using a chopper pump.

Another form of chemical pulping is the sulfite pulping process, which due to the different digestion chemistry employed, does not produce screen rejects that are suitable for reprocessing. In particular, sulfite rejects differ from Kraft rejects in both hardness (lignin content) and lignin structures. The lignin content of sulfite rejects can be high relative to the hardness of rejects from the Kraft process. Furthermore, the lignin present in sulfite rejects is highly condensed due to the acid-induced lignin condensation in the digestion step. For these reasons, known reject processing and reclamation methods, such as those employed in mechanical pulping, or in the Kraft process, have not been suitable for processing sulfite screen rejects.

Presently, due to their incompatibility with screen processing methods tailored for the Kraft process, sulfite rejects are often disposed by burning them in a boiler, in order to extract residual energy. Unfortunately, the high sulfur content of the sulfite rejects makes this option less favorable, partly because of the potential for corrosion in the boiler, and also because of air pollution caused by the formation of sulfur dioxide. Alternatively, sulfite rejects may be removed and sent to a landfill. This approach is problematic due to the high landfill fee and in the potential environmental hazard.

SUMMARY

Systems and methods are provided for refining and reclaiming rejects in a sulfite pulping process. Wood chips and sulfite cooking liquor are provided to a digester for delignification. The slurry obtained from the digester is screened to obtain a reject portion containing sulfite rejects. The sulfite rejects are disintegrated in a refiner, such that the rejects are refined to a freeness suitable for digestion in a subsequent re-cooking step. Refined rejects are then returned to the digester for re-cooking with wood chips.

In one aspect, there is provided a method of refining sulfite rejects obtained during acid sulfite pulping or bisulfite pulping, the method comprising: providing wood chips and a sulfite cooking liquor to a digester and digesting the wood chips at a suitable temperature for obtaining delignification; screening a slurry obtained from the digester to separate a reject portion from an accept portion, the reject portion including sulfite rejects; providing the sulfite rejects to a refiner, wherein the refiner is adapted to disintegrate the sulfite rejects; refining the sulfite rejects to obtain refined sulfite rejects having a freeness suitable for digestion in a subsequent re-cooking step; and returning at least a portion of the refined sulfite rejects to the digester for re-cooking with the wood chips.

In another aspect, there is provided A system for sulfite pulping with recovery of sulfite rejects, comprising: a digester adapted to digest wood chips in the presence of a sulfite cooking liquor at a suitable temperature for obtaining delignification; a screening system adapted to screen a slurry obtained from the digester, such that a reject portion is separated from an accept portion, the reject portion including sulfite rejects; and a refiner adapted to disintegrate the sulfite rejects to a suitable freeness for subsequent re-cooking in the digester.

A further understanding of the functional and advantageous aspects of the disclosure can be realized by reference to the following detailed description and drawings.

BRIEF DESCRIPTION OF THE DRAWINGS

Embodiments will now be described, by way of example only, with reference to the drawings, in which:

FIG. 1 is a block diagram illustrating an example system and method of processing and reclaiming sulfite rejects.

DETAILED DESCRIPTION

Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure. It should be understood that the order of the steps of the methods disclosed herein is immaterial so long as the methods remain operable. Moreover, two or more steps may be conducted simultaneously or in a different order than recited herein unless otherwise specified.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately", when used in conjunction with ranges of dimensions of particles, compositions of mixtures or other physical properties or characteristics, are meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present disclosure.

Embodiments of the present disclosure provide systems and methods for reclaiming sulfite rejects. Unlike rejects from the Kraft process, which are readily disintegrated due to their softness and low lignin content and low degree of lignin condensation, sulfite rejects are typically hard due to acid-induced lignin condensation. The chemical composition of sulfite rejects is often similar to that of fresh wood chips, containing mainly cellulose, hemicelluloses and lignin. The amount of sulfite rejects that are generated is typically dependent on the percentage of oversized and knotted wood chips and/or the ability of the sulfite cooking liquor to impregnate the wood chips. The physical shapes of sulfite screen rejects are often very much like the original wood chips. The porosity of the sulfite rejects is often lower than that of the fresh wood chips, and the lignin in the rejects may be substantially condensed due to the acid condensation from the previous sulfite cooking step. Furthermore, the lignin content of the sulfite rejects is very high relative to that of Kraft rejects. For example, the Kappa number for sulfite rejects can exceed approximately 80, or even higher than 100 in some cases.

Accordingly, sulfite rejects, unlike Kraft rejects, have significant structural and compositional differences that make them unsuitable for re-cooking with fresh wood chips. It is for this reason that prior to the present disclosure, no mill has ever been able to reclaim sulfite rejects and reprocess them in the digester. Instead, as noted above, the typical industrial practice has been to either burn the sulfite rejects, or to transport them to landfill sites.

In order to overcome the incompatibility of sulfite rejects with subsequent re-cooking, embodiments of the present disclosure provide systems and methods of refining and reclaiming sulfite screen rejects as a usable fiber material for pulp production. Unlike methods that have been developed and tailored to the Kraft process, embodiments disclosed herein are adapted to address the high lignin content and lignin condensation characteristic of sulfite screen rejects. In some embodiments, systems and methods are disclosed whereby sulfite rejects are refined in order to produce refined sulfite rejects having a pre-selected freeness, and the refined sulfite rejects are added, in a pre-selected quantity, with regular wood chips, to the digester for subsequent processing in the digester. Embodiments of the present disclosure thus enable the reuse and reclaiming of the fibers in the sulfite rejects, providing a reprocessing method that is suitable for composition of the sulfite rejects, and creating value for sulfite rejects that may otherwise be disposed of as waste.

The refining of the sulfite rejects, according to the methods disclosed herein, physically separates the rejects into fibers/fiber bundles before they are added to the digester, so that the refined sulfite rejects are suitably prepared for re-cooking together with fresh wood chips. As described in further detail below, the reclaiming and reprocessing of the fibers in the sulfite rejects may be achieved by adding the processed refined sulfite rejects to the digester in a suitable quantity, with a suitable freeness. By providing the refined sulfite rejects to the digester in suitable quantity and a suitable freeness, the cooking liquor is able to diffuse into the refined sulfite rejects upon subsequent cooking.

Referring now to FIG. 1, an example block diagram is provided that illustrates an embodiment in which a bisulfite pulping process is adapted to reprocess the sulfite rejects, and to subsequently combine the refined sulfite rejects with fresh wood chips for further processing in the digester. As shown in the FIGURE, wood chips 5 and sulfite treatment liquor 10 are initially provided to digester 15, where the wood chips undergo an initial delignification step.

In an example and non-limiting embodiment, the digestion/delignification step is performed as follows. Wood chips are loaded into the digester, which may use some steam to improve chip loading/filling. Sulfite cooking liquor is then added in a suitable quantity. For example, sulfite cooking liquor may be provided at a charge of 20-26% on wood (as $SO_2$). Steam may be added to increase the temperature to approximately 110-120° C., and having a pressure release to improve the liquor penetration into wood chips. The temperature may then be increased to its target maximum temperature. The maximum temperature for bisulfite cooking may be in a range of 155 to 170° C., or, for example, from 160 to 165° C. The maximum temperature for acid sulfite cooking may be in a range of 125 to 150° C., or, for example, from 132 to 142° C. After having achieved the maximum temperature, this temperature is maintained for a suitable time period. In some implementations, the time period may range from approximately 90 to 180 minutes.

The resulting slurry 20 is washed in washing system 22. Different types of commercial washing systems can be used, including vacuum washers, wash deckers, wash filters and wash presses, in order to remove and/or recover the cooking liquor and dissolved organics 24.

The washed slurry 25 is then screened in screening system 30. Screening system 30 separates reject portion 40 from accept portion 35. In one example implementation, the screening system may be knotter screens or flat screens.

The reject portion 40, which includes the sulfite rejects, is then provided to the reject refiner 45, such that the rejects are suitably refined prior to being re-cooked in the digester.

Due to the very high hardness and acid induced lignin condensation, the sulfite rejects need to be physically separated into fibers/fiber bundles before they can be added to the digester in the sulfite pulping process. Reject refiner 45 is adapted to disintegrate the sulfite rejects to a suitable freeness, such that the refined sulfite rejects 50 are suitable for digestion in a subsequent re-cooking step.

In one example embodiment, the physical separation of sulfite rejects to a suitable freeness is achieved by a chip refiner. For example, in one implementation, the reject refiner 45 may be a double disc refiner having two refining plates (discs) that undergo relative motion, such that the plates are separated by a narrow gap. An example plate separation is in the range of 0.005-0.020 inches. The plates may have bars and/or grooves, so that the rejects are torn apart when passing through the refiner. The freeness may be adjusted by controlling the plate gap of the refiner and/or energy input to the refiner.

In one example embodiment, the refined sulfite rejects 50 may have a solid content of approximately 20 to 40%, while in another example embodiment, the solid content may be between approximately 25 to 35%. The refined rejects can be diluted in water to form slurry. The refined sulfite rejects 50 may be continuously provided to the inlet of the refiner, or may be provided in a batch process.

In another embodiment, the refiner may be a single or double disc refiner with the gap setting at the target and also with energy input of 15 to 45 kWh/ton, more preferably 20 to 30 kWh/ton While the single and double disc refiners have been described as example implementations of refining systems capable of producing a refined sulfite rejects 50 with a suitable freeness for re-cooking, it is to be understood that other refiners or disintegration systems or devices may alternatively be employed. Non-limiting examples of other suitable systems or devices include fiber fluffing machines and grinders.

The sulfite rejects may be further treated by adding more cooking liquor before the reject refining process.

As noted above, the degree of fiber separation can be measured as the Canadian Standard freeness (CSF). In some embodiments, the sulfite rejects are processed such that refined sulfite rejects 50 are formed having a freeness of approximately 740 mL CSF. In some example implementations, the processed refined sulfite rejects 50 may have a freeness of approximately 600-900 mL CSF, more preferably 680-800 mL CSF.

In one embodiment, the freeness may be optionally determined, in order to ensure that a suitable freeness level is obtained prior to addition of the refined sulfite rejects 50 to the digester for re-cooking. The measured freeness may be provided as a feedback parameter to control the process parameters of the refiner 45, such as, but not limited to, the plate gap of the refiner (in the case of a disc refiner) and/or energy input to the refiner. For example, if the freeness is too low, then an unnecessary amount of energy would be consumed during the refining process, and the strength properties of the resulting paper would be compromised, while on the other hand, if the freeness is too high, then the refining of the fibers has been insufficient. In another example implementation, if the freeness is found to be too high, the refined sulfite rejects 50 may be further refined (as shown at 60) prior to being re-cooked in the digester. Further refining 60 may involve additional refining in reject refiner 45, or additional refining in another reject refiner.

After having refined the rejects to a suitable freeness, the refined sulfite rejects 50 are provided, in a suitable quantity, to the digester for re-cooking. In one embodiment, the refined rejects are added directly to digester 15. For example, refined rejects will typically still contain some residual cooking liquor (from the previous cooking process), and the sulfite cooking chemicals have a strong odour, and thus it may be preferable for the sulfite rejects to be added directly to the digester. In other embodiments, the refined sulfite rejects may be added to the fresh wood chips and subsequently provided to the digester. The refined sulfite rejects can be sent to the digester by using a conveyer, or a blower line, or if diluted, can be pumped.

In one embodiment, the quantity of refined sulfite rejects 50 added to the digester 15 may be controlled by selecting an appropriate quantity of sulfite rejects to be supplied to reject refiner 45.

In some embodiments, the quantity of refined sulfite rejects 50 added to the digester 15, relative to the total number of wood chips 5 added to the digester, may be approximately 2% by weight. In some example implementations, the quantity of refined sulfite rejects 50 relative to the quantity of wood chips 5 may be approximately 0.5-3.5% by weight, more preferably 0.5-2.5% by weight.

It is to be understood that the processes disclosed herein are applicable to a batch digester process or a continuous digester process.

Although many of the example embodiments provided herein pertain to bisulfite pulping, it is to be understood that the systems and methods disclosed herein may be applied to other sulfite pulping processes, including, but not limited to the acid sulfite pulping process.

The following examples are presented to enable those skilled in the art to understand and to practice embodiments of the present disclosure. They should not be considered as a limitation on the scope of the present embodiments, but merely as being illustrative and representative thereof.

EXAMPLES

Pulping

Sulfite rejects made of mainly softwood (spruce) with a small amount of hardwood (aspen) from a sulfite pulping process were refined in a single disc refiner to a freeness of approximately 800 mL Canadian Standard Freeness (CSF). The refined rejects were added to the wood chips in a quantity of approximately 3% by weight, and cooked in a laboratory batch digester. The resulting properties of the pulp, after washing, but before bleaching, are summarized in Table 1 below.

Trial #1 was performed as a control without the refining and recooking of rejects. For Trial #2 the Kappa number was somewhat lower than the control (due to a slightly lower pH). Therefore Trial #3 was carried out, whereby the cooking time was shortened by 10 min (130 min versus 140 min); the resulting pulp has a Kappa number of 28.3, which is close to that of the control (30.4).

TABLE 1

| Trial # | ID | Time at 164° C. | End pH | Kappa number | Reject, % on pulp | Brightness, % ISO |
|---|---|---|---|---|---|---|
| 1 | control | 140 min | 2.60 | 30.4 | 0.22 | 62.1 |
| 2 | 3% refined rejects | 140 min | 2.45 | 26.5 | 0.31 | 62.0 |
| 3 | 3% refined rejects | 130 min | 2.56 | 28.3 | 0.33 | 61.7 |

Bleaching

The three pulps were then subjected to the bleaching sequence with a target of final brightness of greater than 89%. The results are shown below in Table 2.

TABLE 2

| Results of Bleaching ($D_0E_p(DH)$) | |
|---|---|
| | Brightness, % ISO |
| control | 89.5 |
| 3% refined rejects, Kappa # 26.5 | 89.4 |
| 3% refined rejects, Kappa # 28.3 | 89.5 |

Strength Properties 4-point beating curves were performed on the three fully-bleached pulps, and the results are shown in Table 3. Different PFI revolution was used to refine the bleached pulp to different degrees, and the final freeness of the bleached pulp (which is different from that of the sulfite rejects). It is clear from the results that the strength properties are very similar among the different samples.

TABLE 3

| Results on Strength Properties | | | | |
|---|---|---|---|---|
| | PFI Rev | CSF, ml | Breaking length, km | Tear Index, mN $m^2/g$ |
| control | 0 | 690 | 8.32 | 12.02 |
| | 300 | 665 | 10.81 | 9.74 |
| | 1000 | 620 | 11.75 | 8.72 |
| | 2000 | 570 | 12.11 | 8.53 |
| 3% refined | 0 | 680 | 8.51 | 11.17 |
| rejects | 300 | 650 | 10.46 | 9.50 |
| Kappa 26.5 | 1000 | 590 | 11.52 | 8.49 |
| | 2000 | 520 | 12.25 | 8.09 |
| 3% refined | 0 | 665 | 8.91 | 10.48 |
| rejects | 300 | 645 | 10.81 | 9.21 |
| Kappa 28.3 | 1000 | 590 | 11.58 | 8.46 |
| | 2000 | 515 | 11.92 | 7.84 |

In other tests, rejects were refined to different freeness levels, ranging from 687 to 850 mL CSF, and added to the digester which contained the regular wood chips, at 1 to 3% reject addition percentage (relative to the total weight of the wood chips in the digester). Similar results to those provided above were obtained.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

Therefore what is claimed is:

1. A method of refining sulfite rejects obtained during acid sulfite pulping or bisulfite pulping, the method comprising:

providing wood chips and a sulfite cooking liquor to a digester and digesting the wood chips at a suitable temperature for obtaining delignification;

screening a slurry obtained from the digester to separate a reject portion from an accept portion, the reject portion including sulfite rejects comprising condensed lignin, wherein the condensed lignin was formed by acid-induced condensation;

providing the sulfite rejects to a refiner, wherein the refiner is adapted to disintegrate the sulfite rejects;

refining the sulfite rejects to obtain refined sulfite rejects having a Canadian standard freeness between approximately 600 ml and 900 ml; and returning at least a portion of the refined sulfite rejects to the digester for re-cooking in the sulfite cooking liquor with additional wood chips.

2. The method according to claim 1 wherein the Canadian Standard Freeness of the refined sulfite rejects is between approximately 680 ml and 800 ml.

3. The method according to claim 1 wherein the quantity of refined sulfite rejects returned to the digester, relative to the quantity of the additional wood chips provided to the digester, is approximately 0.5% to 3.5% by weight.

4. The method according to claim 1 wherein the quantity of refined sulfite rejects returned to the digester, relative to the quantity of additional wood chips provided to the digester, is approximately 0.5% to 2.5% by weight.

5. The method according to claim 1 wherein a Kappa number of the sulfite rejects exceeds approximately 80.

6. The method according to claim 1 wherein the refiner is a disc refiner.

7. The method according to claim 6 wherein the disc refiner is configured such that a plate separation is approximately 0.005 to 0.020 inches.

8. The method according to claim 6 further wherein an energy input to the disc refiner is between approximately 15 and 45 kWh/ton.

9. The method according to claim 6 further comprising adjusting the Canadian standard freeness of the refined sulfite rejects by varying one or more of a plate gap of the disc refiner and an energy input to the disc refiner.

10. The method according to claim 1 wherein the refined sulfite rejects have a solid content between approximately 20% and 40%.

11. The method according to claim 1 further comprising adding additional cooking liquor to the refined sulfite rejects prior to returning the refined sulfite rejects to the digester.

12. The method according to claim 1 wherein the refined sulfite rejects are returned to the digester in a continuous process.

13. The method according to claim 1 wherein the refined sulfite rejects are returned to the digester in a batch process.

* * * * *